United States Patent [19]

Schoen

[11] 4,311,086

[45] Jan. 19, 1982

[54] SYSTEM FOR DAMPING ABRUPT MOVEMENT OF A PUNCH PRESS RAM

[76] Inventor: Hans Schoen, Lange Horst 87, 4320 Hattingen, Fed. Rep. of Germany

[21] Appl. No.: 131,582

[22] Filed: Mar. 19, 1980

[30] Foreign Application Priority Data

Mar. 26, 1979 [DE] Fed. Rep. of Germany ..... 2911820

[51] Int. Cl.[3] ..... F15B 15/22

[52] U.S. Cl. ..... 92/10; 83/617; 91/41; 92/85 B; 92/143; 92/146; 267/119

[58] Field of Search ..... 92/85 B, 143, 146, 61, 92/8, 10, 60, 89; 92/41; 267/119; 83/617, 639

[56] References Cited

U.S. PATENT DOCUMENTS 2,300,162 10/1942 Maude ..... 267/119
3,205,749 9/1965 Schenk ..... 92/10
3,744,380 7/1973 Steiger ..... 92/61
4,214,496 7/1980 Carrieri ..... 83/617
4,233,872 11/1980 Schulze ..... 267/119

FOREIGN PATENT DOCUMENTS 52-31214 3/1977 Japan ..... 92/61

*Primary Examiner*—Abraham Hershkovitz
*Attorney, Agent, or Firm*—Thomas H. Murray

[57] ABSTRACT

A system for damping abrupt movement of a punch press ram at the moment of cut-breakthrough with the use of at least two damping pistons disposed within cylinders and arranged to engage the press ram before and during cut-breakthrough. The cylinders within which the damping pistons are carried are connected to a hydraulic control system which permits the pistons to yield with the ram until the instant of cut-breakthrough, whereupon the damping pistons act as rigid bodies and prevent abrupt breakthrough movement of the ram.

4 Claims, 1 Drawing Figure

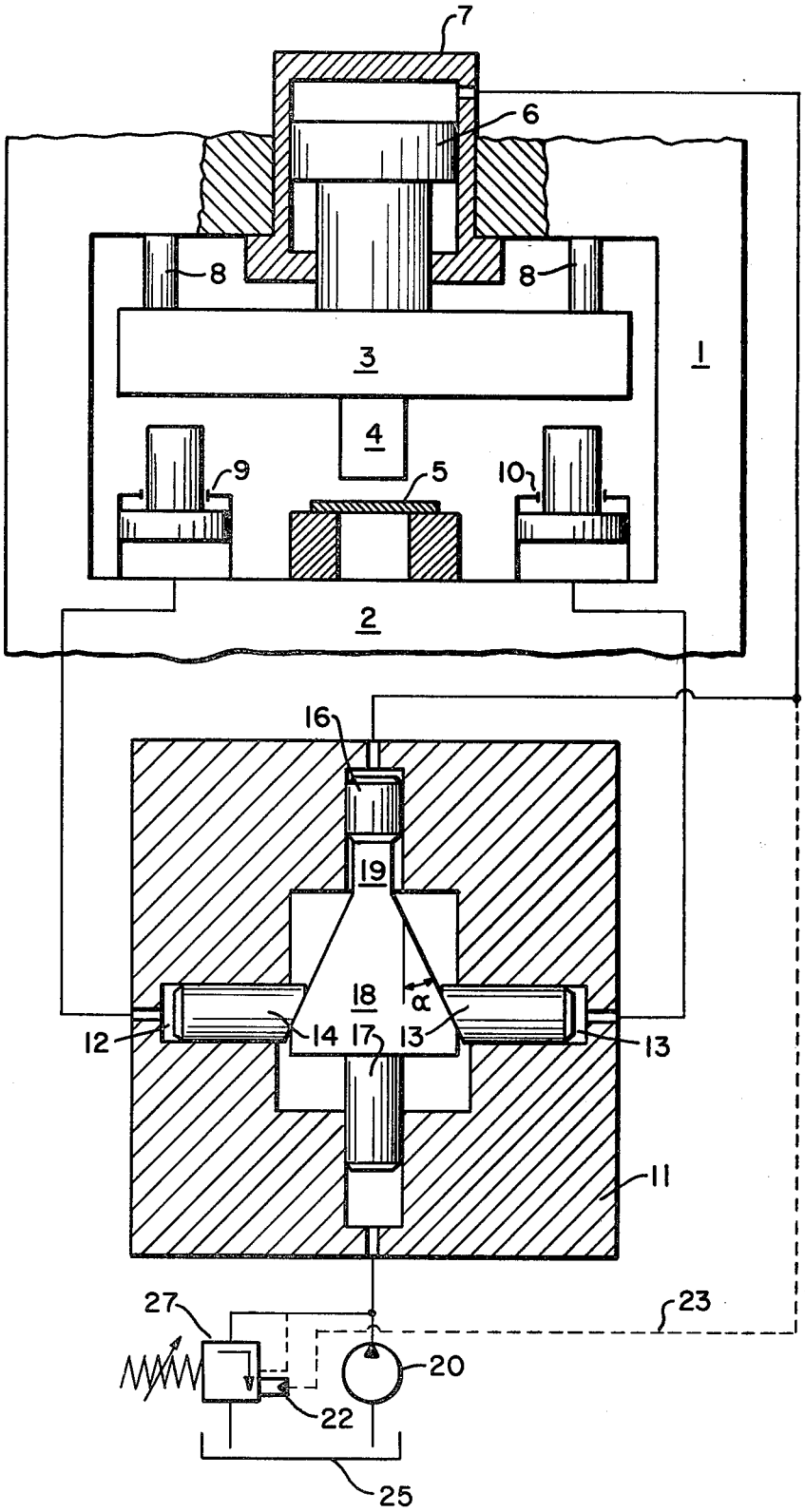
7
6
8
8
3
1
4
9
5
10
2
16
19
18
α
12
14
17
13
13
11
27
23
20
22
25

SYSTEM FOR DAMPING ABRUPT MOVEMENT OF A PUNCH PRESS RAM

BACKGROUND OF THE INVENTION

While not limited thereto, the present invention is particularly adapted for use with hydraulic punch presses of the type wherein a ram forces a tool through a metal workpiece, for example. The power stroke of a press of this type can be divided into a pressure build-up phase and a cut-breakthrough phase. During the pressure build-up phase, the workpiece undergoes plastic deformation; while the press frame and its component parts are subjected to elongation, depending upon their elasticity. Under these conditions, they store energy depending upon the maximum cutting force. At the instant of cut-breakthrough, however, this energy is abruptly liberated and is converted into vibrational energy which is radiated as noise. In hydraulic punching presses there is also an explosive acceleration of the ram at the instant of cut-breakthrough. These events take place in a fraction of a millisecond and, apart from the undesirable noise, produce excessive wear on the tool and press parts.

In the past, hydraulic systems have been provided for damping cutting impacts to obviate the aforesaid undesirable phenomena. The main component of such systems is a hydraulic damping cylinder which produces a counteracting force on the press ram and is intended to prevent the press frame from being abruptly relieved of loading after the cut-breakthrough. The main disadvantage of such prior art systems, however, is that a major portion of the force exerted by the press ram is lost as a result of the counteracting force of the damping cylinder.

In order to avoid losses in the force exerted by the ram as far as possible, attempts have been made to control the damping cylinder by means of a valve system. One such valve system, for example, is shown in German Offenlegungsschrift No. 25 12 822, published Sept. 30, 1976. It utilizes a relief valve connected to the damping cylinder and is responsive to a pressure control system such that the cross-sectional area of the restriction it presents to fluid flow is reduced in size as the cutting impact occurs. A system of this type, however, is relatively complex and also has a disadvantage in that the transmission elements must be accurately set up according to the ram travel and the position of the ram at cut-breakthrough.

SUMMARY OF THE INVENTION

In accordance with the present invention, a new and improved system for damping abrupt movement of a punch press ram is provided whereby cutting impact noise is practically completely eliminated but there is nevertheless only a slight loss of force exerted by the punch press ram. The damping cylinders utilized in the invention can be readily fitted to a conventional punch press without requiring any appreciable space. Pressure control for the damping cylinders is obtained by means of a simple and reliable hydraulic control system.

Specifically, there is provided a system for damping abrupt movement of a punch press ram at the moment of cut-breakthrough with the use of at least two damping ram-type pistons disposed within cylinders and arranged to engage the press ram before and during cut-breakthrough. The pressure in the cylinders for the ram-type pistons is controlled by a hydraulic system comprising a movable wedge-shaped member having an upper surface, a lower surface and inclined side surfaces which converge toward the upper surface. First and second coaxial pistons disposed within cylinders are provided with inclined end surfaces in contact with the inclined side surfaces of the wedge-shaped member. Conduit means connects the respective cylinders for the coaxial first and second pistons to the respective cylinders for the damping ram-type pistons. A third piston is in engagement with the upper surface of the wedge-shaped member and is disposed within a cylinder which is subjected to a pressure dependent upon the pressure exerted by the ram. Finally, a fourth piston in engagement with the lower surface of the wedge-shaped member is disposed within a cylinder connected to a source of fluid under pressure.

The arrangement is such that as the ram forces a tool through a workpiece, the third piston will force the wedge-shaped member downwardly to permit the first and second pistons to move toward each other and cause the damping pistons to yield in synchronism with the punch press ram until the instant of cut-breakthrough, whereupon the pressure exerted by the second piston on the wedge-shaped member drops and the damping ram-type pistons act as rigid bodies and prevent abrupt breakthrough movement of the ram.

The control system of the invention offers a number of advantages. One of the main advantages is that the damping cylinders do not offer any appreciable resistance to the press ram during its uniform lowering movement until the instant of cut-breakthrough. This means that the rated power of the punch press can be fully utilized. At the instant of cut-breakthrough, however, the damping cylinders behave as rigid members and thus prevent abrupt breakthrough of the ram so that the noise normally occurring at that instant is avoided. After cut-breakthrough, the upward movement of the ram is immediately initiated via the normal control system with the damping pistons acting to assist in forcing the ram upwardly.

The use of two damping cylinders disposed symmetrically with respect to the central axis of the ram provides absolutely parallel guidance of the ram and thus also acts as a synchronous control system. In the event of the ram being tilted, one of the two damping cylinders is relieved of pressure and, hence, the force acting on its associated piston in engagement with an inclined side surface of the wedge-shaped member ceases. As a result, downward movement of the wedge-shaped member is interrupted; and since the piston on the other side of the wedge-shaped member can no longer yield, its associated damping cylinder sets up practically a rigid resistance to the ram and thus corrects the initial tilting thereof.

The above and other objects and features of the invention will become apparent from the following detailed description taken in connection with the accompanying single FIGURE drawing which schematically illustrates one embodiment of the invention.

With reference now to the drawing, the punch press shown includes a frame 1, a bed 2 and a reciprocable ram 3 disposed above the bed 2. Carried on the ram 3 is a punch or tool 4 adapted to engage a workpiece 5 and, for example, punch an opening in it. The ram 3 is connected to a piston 6 disposed within a main or master cylinder 7. A suitable hydraulic system, not shown, is provided for pressurizing the upper or lower sides of the piston 6, depending upon whether upward or downward movement of the ram 3 is desired. Guide rods 8 are provided on opposite sides of the ram 3 to provide parallel guidance for the same. The rods may be secured to the frame 1 or the ram 3 and are longitudinally slideable in suitable bushings in the other component, respectively.

Damping cylinders 9 and 10 are provided on the bed 2 on either side of the central axis of the ram 3. The piston rods of the pistons within the cylinders 9 and 10 project out of the latter such that their end faces can come into pressure contact with the underside of the ram 3 when the same is lowered during a punching operation.

The control system for the press includes a housing 11 in which four pistons are mounted in the form of a cross for axial movement in cylinders or bores provided in the walls of the housing. First and second pistons 12 and 13 are provided in two opposite walls of housing 11 and have inclined end surfaces adapted to engage sloping side wall surfaces of a wedge-shaped member 18. The pressure chambers 14 and 15 situated behind the pistons 12 and 13 are connected via conduits to the damping cylinders 9 and 10, respectively.

A third control piston 16 and a fourth control piston 17 are mounted at right angles to the pistons 12 and 13 in the housing 11 and engage the upper and lower surfaces, respectively, of the wedge-shaped member 18. Inclined side surfaces of the wedge-shaped member 18 are at an angle $\alpha$ with respect to its longitudinal axis. The apex of the wedge-shaped member 18 merges into a cylindrical projection 19 which is in pressure contact with the piston 16.

The angle of inclination $\alpha$ of the inclined side surfaces of member 18 has no effect on the basic operation of the control system. However, the angle must be taken into account when the system is designed since variations in this angle also result in variations of the travel of the pistons 12 and 13 and, hence, the pistons in damping cylinders 9 and 10 in relation to the ram 3. Practical values for the angle of inclination $\alpha$ range from 10°–30°.

A pressure chamber above piston 16 is connected through a conduit to the upper pressure chamber of the cylinder 7. The pressure chamber beneath the piston 17, on the other hand, is connected to the output port of a pump 20 whose suction port is connected to a hydraulic reservoir 25. Additionally, the pressure chamber beneath piston 17 is connected through an adjustable pressure regulator 27 to the same reservoir 25. Pressure regulator 27 is provided with means for adjusting the pressure which can exist in the pressure chamber beneath piston 17 and also includes a port 22 which is connected through conduit 23 to the upper pressure chamber of the master cylinder 7. This arrangement facilitates automatic adjustment of the pressure regulator 27 as a function of the pressure above the ram piston 6. That is, as the pressure in master cylinder 7 increases so also does the pressure in the chamber beneath piston 17 so that there is a continual counterbalancing effect between the pressures exerted on the wedge-shaped member 18 by the pistons 16 and 17. The relationship between the forces exerted by the pistons 12, 13, 16 and 17 must be:

$$P_2 < P_1 + (P_3 + P_4) \cdot \tan \alpha$$

where:

$P_1$ is the force exerted by piston 16;

$P_2$ is the force exerted by piston 17; and $P_3$ and $P_4$ are the forces exerted by pistons 12 and 13.

The foregoing relationship establishes that force $P_2$ exerted by the piston 17 must be slightly less than the sum of the other forces during downward movement of the ram and until cut-breakthrough. Satisfactory operation is obtained if the force $P_2$ exerted by piston 17 is a few percent less than the sum of the counteracting forces.

As the force $P_1$ of the piston 16 and the forces $P_3$ and $P_4$ of the pistons 12 and 13 overcome the force $P_2$ exerted by piston 17, the result is downward movement of the member 18. During this downwad movement, the damping cylinders 9 and 10 do not offer any appreciable resistance to the ram 3 since the fluid displaced from these cylinders is taken up in the pressure chambers 14 and 15 as the pistons 12 and 13 move inwardly.

At the instant of breakthrough, however, there is an abrupt relief of pressure in the pressure chamber above piston 6 and, hence, the pressure chamber above piston 16. In this regard, the force $P_1$ exerted by the piston 16 drops toward zero. Piston 17 now blocks further downward movement of the member 18 and, consequently, inward movement of the two pistons 12 and 13. As a result, the pistons in cylinders 9 and 10 can no longer yield against the force of ram 3 and behave as rigid bodies.

A normal press control system, not shown, initiates upward movement of the ram 3 at the instant of cut-breakthrough. The press frame 1, therefore, starts to be relieved of loading at this time, but this does not occur abruptly since the member 18 is now pressed upwardly by the force $P_2$ of piston 17. As a result, pistons 12 and 13 are moved outwardly, causing the pistons in cylinders 9 and 10 to press against the ram 3. This counteracting force thus provides smooth relief of the loading on the frame 1.

The following conditions in respect to the forces operating on the member 18 must be taken into account to achieve the above-described synchronous control:

$$P_1 + P_3 \tan \alpha < P_2$$

and $$P_1 + P_4 \tan \alpha < P_2$$

The foregoing expressions state that the sum of the forces exerted on the member 18 by the piston 16 and one of the pistons 12 or 13 must not be greater than the force exerted by the piston 7. This assures that, in the event that ram 3 tilts during its downward movement, the member 18 can no longer be moved if, for example, one of the two damping cylinders 9 or 10 is relieved of loading as a result of the tilting. Locking of the member 18 prevents any further movement of the piston 13, for example, and hence of its associated damping cylinder 10 which now exerts an instantaneous counteracting force on the ram 3 to counteract and correct the commencing tilt. Since the ram 3 is kept in a horizontal condition at all times, the other damping cylinder 9 now also experiences loading and hence the equilibrium condition is restored on opposite sides of member 18 during the normal lowering of the ram 3.

It will be appreciated that more than two damping cylinders may be used, the only requirement being that two identical groups of damping cylinders must act symmetrically on the ram; all damping cylinders situated on one side of the axis of the ram must be connected to the pressure chamber of one of the pistons 12 or 13; and all damping cylinders situated on the other side of the central axis must be connected to the pressure chamber of the other piston 12 or 13. In addition to the advantages already mentioned, the use of the system according to the invention requires practically no set-up time.

Although the invention has been shown in connection with a certain specific embodiment, it will be readily apparent to those skilled in the art that various changes in form and arrangement of parts may be made to suit requirements without departing from the spirit and scope of the invention. In this respect, it will be appreciated that the system is equally suitable for non-hydraulic (i.e., mechanical) punch presses. In such cases, the system requires a control cylinder 16 which is actuated or pressurized as the mechanically-actuated press lowers a ram and depressurized when the load on the ram drops at cut-breakthrough. The latter function can be accomplished for example, with the use of suitable strain gages.

I claim as my invention:

1. In a system for damping abrupt movement of a punch press ram at the moment of cut-breakthrough with the use of at least two damping ram-type pistons disposed within cylinders and arranged to engage the press ram during cut-breakthrough; the improvement of means for controlling the pressure in said cylinders and the damping effect of said cylinders, which comprises a movable wedge-shaped member having an upper surface, a lower surface and inclined side surfaces converging toward said upper surfaces, first and second coaxial pistons disposed within cylinders and having inclined end surfaces in contact with the inclined side surfaces of said wedge-shaped member, conduit means connecting the cylinders of the coaxial first and second pistons to the respective cylinders for said ram-type damping pistons, a third piston in engagement with the upper surface of the wedge-shaped member and disposed within a cylinder which is subjected to a pressure dependent upon the pressure exerted by said ram, a fourth piston in engagement with the lower surface of said wedge-shaped member and disposed within a cylinder, and a source of fluid under pressure connected to said last-named cylinder, the arrangement being such that as the ram forces a tool through a workpiece, the third piston will force the wedge-shaped member downwardly to permit the first and second pistons to move toward each other and cause the damping ram-type pistons to yield in synchronism with the ram until the instant of cut-breakthrough, whereupon the pressure exerted by said third piston on the wedge-shaped member drops and the damping ram-type pistons act as rigid bodies and prevent abrupt breakthrough movement of the ram.

2. The system of claim 1 including a main hydraulic cylinder for actuating said punch press ram, and conduit means connecting said main cylinder to the cylinder which contains said third piston whereby said third piston will be subjected to a pressure dependent upon the pressure exerted on the ram by said main hydraulic cylinder.

3. The system of claim 1 including a pressure regulator connected to the cylinder for said fourth piston.

4. The system of claim 3 wherein said pressure regulator is controlled as a function of the pressure exerted on said ram.

* * * * *